United States Patent [19]

DeFazio et al.

[11] 4,184,292

[45] Jan. 22, 1980

[54] VACUUM CHUCK

[75] Inventors: August DeFazio, Englishtown; Melvin E. Kamen, Woodcliff Lake, both of N.J.

[73] Assignee: Revlon, Inc., New York, N.Y.

[21] Appl. No.: 890,012

[22] Filed: Mar. 24, 1978

[51] Int. Cl.[2] ..... B24B 41/06

[52] U.S. Cl. ..... 51/235; 51/216 LP; 269/21

[58] Field of Search ..... 51/216 LP, 235; 269/21; 279/1 B, 1 D, 3; 294/64 A, 64 B

[56] References Cited

U.S. PATENT DOCUMENTS

| | | | |
|---|---|---|---|
| 2,715,304 | 8/1955 | Dix | 51/236 |
| 2,998,256 | 8/1961 | Lipkins | 51/235 X |
| 3,716,307 | 2/1973 | Hansen | 294/64 A X |
| 3,794,314 | 2/1974 | Coburn et al. | 269/21 |
| 3,912,317 | 10/1975 | Ohnaka | 294/64 A X |
| 3,971,170 | 7/1976 | Coburn et al. | 51/235 X |
| 4,073,602 | 2/1978 | Cagle | 294/64 A X |

FOREIGN PATENT DOCUMENTS

| | | | |
|---|---|---|---|
| 2270988 | 12/1975 | France | 51/216 LP |
| 718456 | 11/1954 | United Kingdom | 294/64 B |
| 1036586 | 7/1966 | United Kingdom | 294/64 B |

*Primary Examiner*—Harold D. Whitehead
*Assistant Examiner*—Robert P. Olszewski
*Attorney, Agent, or Firm*—Leon E. Tenenbaum

[57] ABSTRACT

A vacuum chuck for use in lens grinding having a vertical bore extending downwardly into the block to join a through horizontal bore provided with a venturi, so that by blowing air through the venturi a vacuum is created in the vertical bore to secure the lens placed on top of the block.

6 Claims, 10 Drawing Figures

FIG. 4
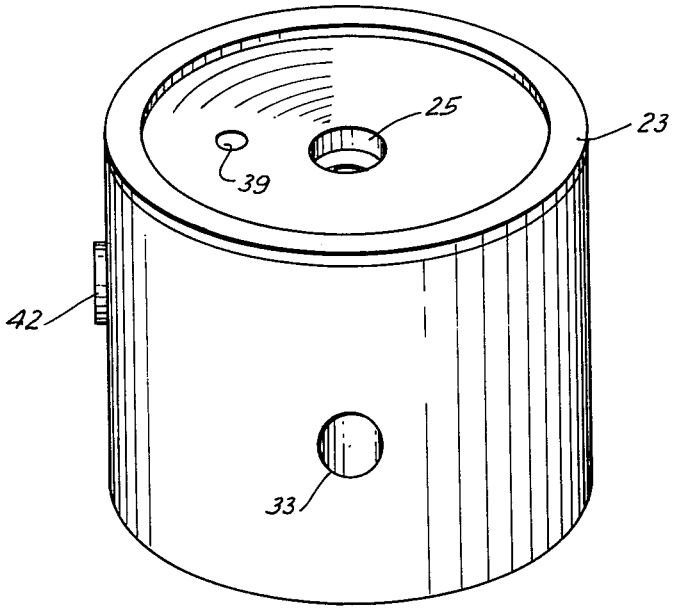
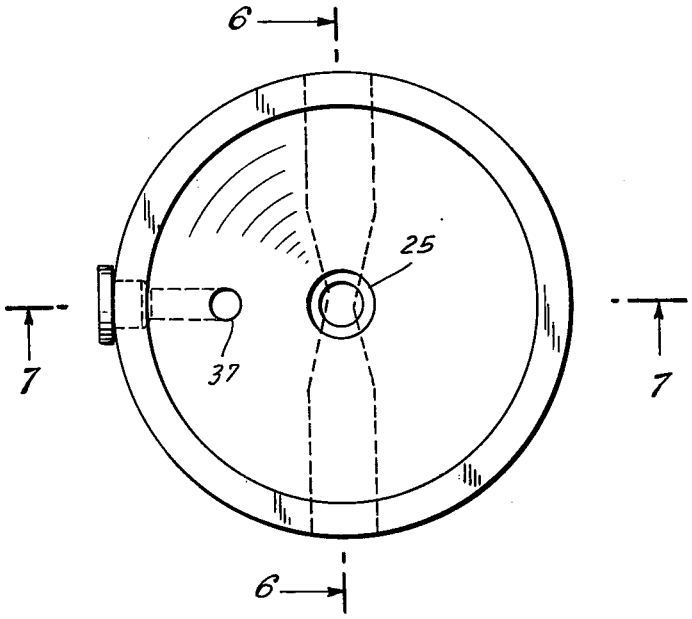
FIG. 5

FIG. 6
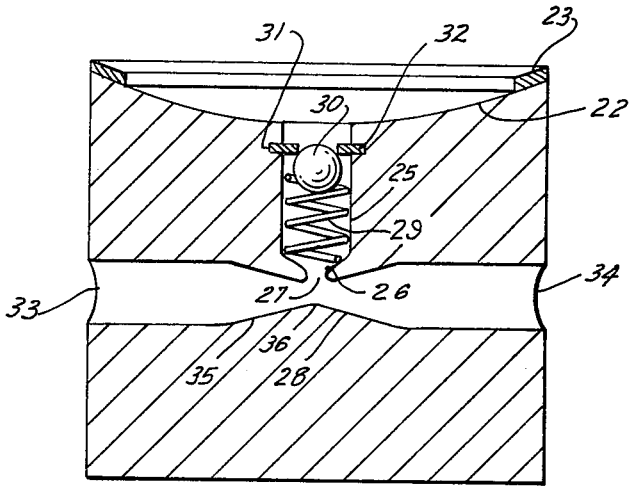
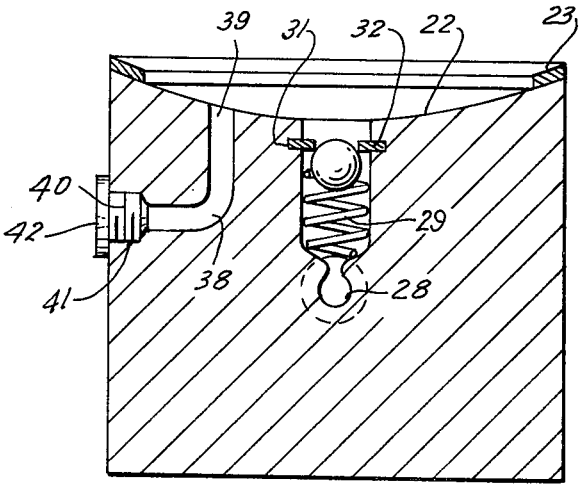

VACUUM CHUCK

This invention relates to ophthalmic lens finishing machinery, and particularly relates to an iproved vacuum chuck for use with such machinery.

One of the most troublesome aspects in finishing lens blanks to specified curvatures is the gripping of the lens during processing. The lens blank, which is constructed of either glass or plastic, is somewhat fragile and must be gripped in such a manner that one of its surfaces can be generated. The prior art teaches many ways of blocking a lens for these purposes. A common method is to secure a steel block to one lens surface through the use of pitch or the like. Another common method is to form a metallic block of a low melting alloy. Still another method involves the placing of a lens on a support provided with openings through which a low melting alloy is fed to contact the lens, solidify and secure the lens to the support. Different alloys are required depending upon the material used in the lens; a low melting alloy for plastic lenses and a higher melting one for glass lenses. In each of these methods the lens blank must be oriented with respect to the block and after finishing, the block must be removed, and the lens cleaned of any adhering pitch or alloy. For economic reasons the pitch or alloy must also be recovered. However, after repeated use the alloy becomes contaminated and has to be purified, since the contamination not only results in changes in properties of the alloy, but frequently causes discolorations in the lenses.

To overcome the problems and disadvantages inherent in the use of pitch or alloys in securing the lens, other techniques have been developed. Principally among such techniques is the use of a vacuum to secure the lens to a chuck as is described in U.S. Pat. No. 3,794,314.

While the use of the vacuum chuck described in the above-mentioned patent does indeed overcome the problems connected with the use of pitch or alloys in securing the lenses, there are some problems and disadvantages in using this particular vacum chuck.

The vacuum is obtained by use of a vacuum pump to evacuate the system. This requires pumps of high capacity. Besides, vacuum pumps require frequent maintenance. Furthermore, the vacuum obtained by the method described in the patent is not retained by the system for a sufficient period time, so that the lens is not firmly held in place. If this decrease in or loss of vacuum and the consequent loss in the security of the lens occurs during grinding, the movement of the lens, albeit ever so slight, will result in a defectively ground lens. There is also an excessive wear of the gasket in the vacuum chuck described in the patent, requiring frequent replacement of the gaskets.

It is, accordingly, an object of the present invention to provide a vacuum chuck for securing lens blanks which does not require the use of a vacuum pump to provide the vacuum.

It is another object of the present invention to provide a vacuum chuck for securing lens blanks which holds the vacuum for a period of time sufficient to complete the grinding operation.

It is a further object of the present invention to provide a vacuum chuck for securing lens blanks, whose gasket is not subject to undue wear.

These and other objects of the invention will become apparent to those skilled in the art by reference to the following detailed description when viewed in light of the accompanying drawings wherein:

FIG. 4 is a perspective view of the vacuum chuck shown in FIG. 1 without a lens in place.

FIG. 5 is a top plan view of the vacuum chuck shown in FIG. 4.

FIG. 6 is a sectional view along the line 6—6 of FIG. 5.

FIG. 7 is a sectional view along the line 7—7 of FIG. 5.

Figure 1:
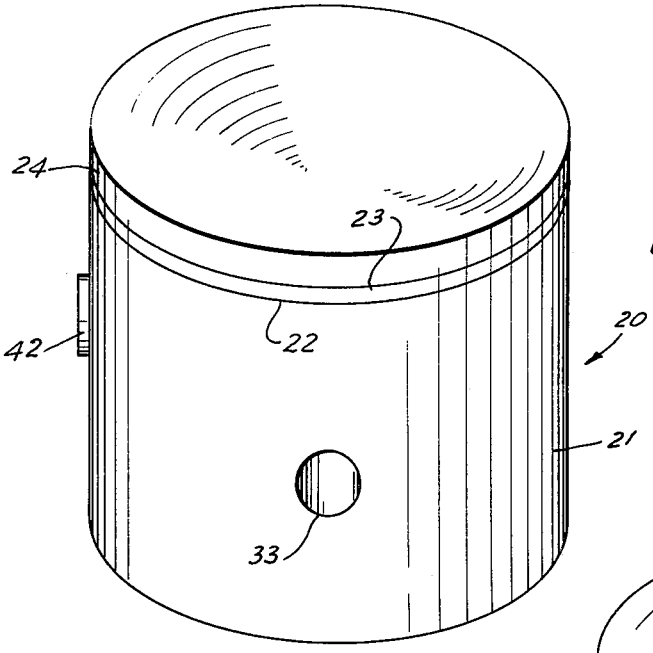
FIG. 1 is a perspective view of one embodiment of the vacuum chuck of the present invention showing a lens in place on top thereof.
Figure 2:
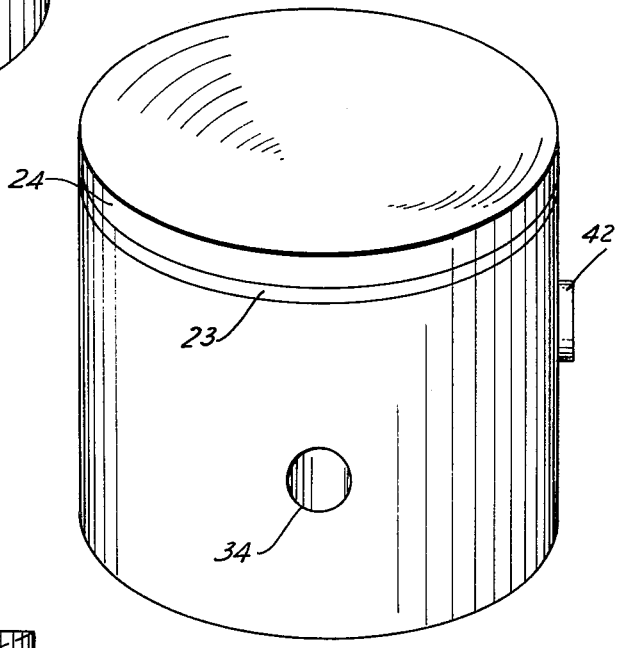
FIG. 2 is a perspective view of the opposite side of the view shown in FIG. 1.
Figure 3:
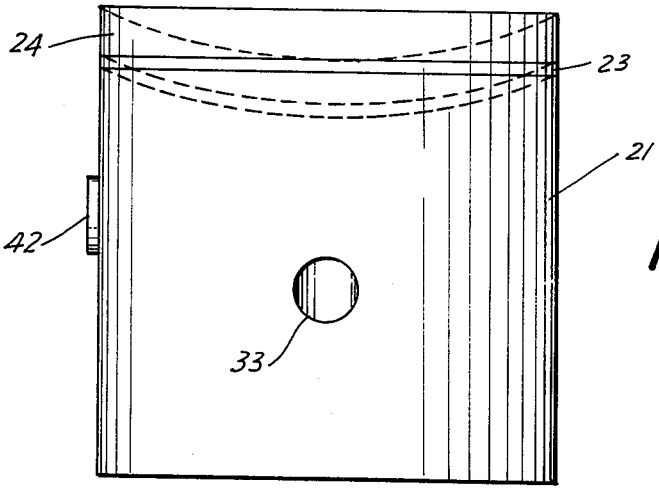
FIG. 3 is a side elevational view of the lens shown in FIG. 1.

Referring now to the drawings where like numerals indicate like parts, reference numeral 20 generally refers to the vacuum chuck of the present invention. The chuck is comprised of a cylindrical block 21 having a concave upper surface 22. The outer edge of the upper surface is provided with an annular gasket 23, whose outer diameter is the same as that of the block. The lens 24 rests on top of the gasket.

One embodiment of the invention is shown in FIGS. 1-7. The block is provided with a vertical circular bore 25 which extends part way from the top into the block and at its bottom 26 has a constricted opening 27 into a through horizontal passageway 28. Resting on the bottom of the vertical bore is a helical spring 29 on which is placed a metal sphere 30, such as a ball bearing. The diameter of the sphere is less than the diameter of the bore, so that the sphere is capable of free movement within the bore. Just below its top opening the bore is provided with an annular groove 31 in which an O-ring 32 is inserted, the inner diameter of said O-ring being less than the diameter of the metal sphere. The through horizontal passageway has two opposed openings 33 and 34. One side 35 of the passageway is constricted as it approaches the center to provide a venturi 36 which meets the opening 27. The other portion 37 of the horizontal passageway is widened beyond the venturi.

The chuck is provided with an L-shaped passageway 38 having a vertical opening 39 at the top of the block and a horizontal opening 40 at the side of the block. The horizontal portion 41 of the passageway is threaded to receive and hold a screw cap 42. The horizontal portion 41 may be in any position or direction relative to the through horizontal passageway 28 and in FIGS. 1-5 and 7, the horizontal portion of the L-shaped passageway is above and at right angle to the through horizontal passageway the opening 33.

The air is blown through the opening 33 and passes through the venturi 36 to create suction through opening 27 thereby drawing the sphere against the spring. The air leaves through the opening 34. Once the air is shut off the spring forces the sphere against the O-ring to produce an air-tight fit.

Figure 8:
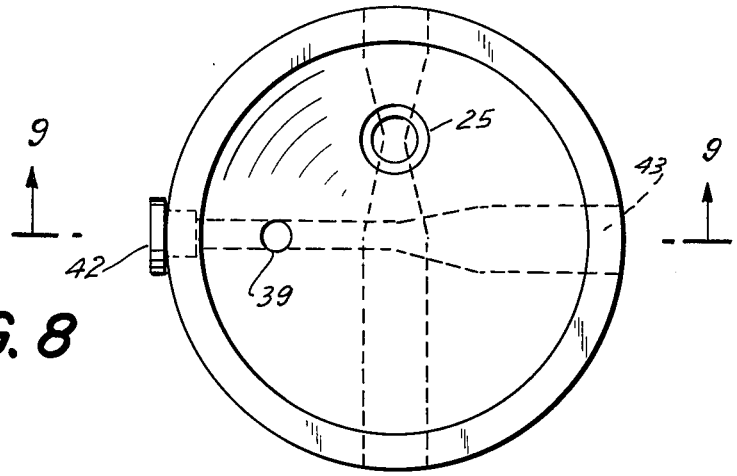
FIG. 8 is a top plan view of another embodiment of the vacuum chuck of present invention.
Figure 9:
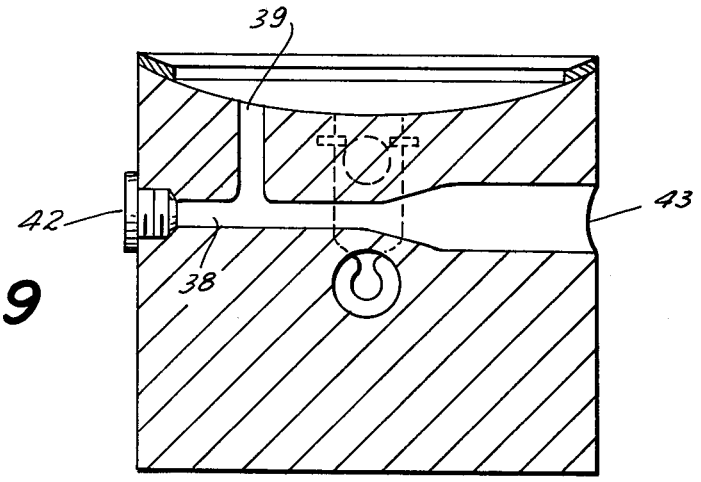
FIG. 9 is a sectional view along the line 9—9 of FIG. 8.
Figure 10:
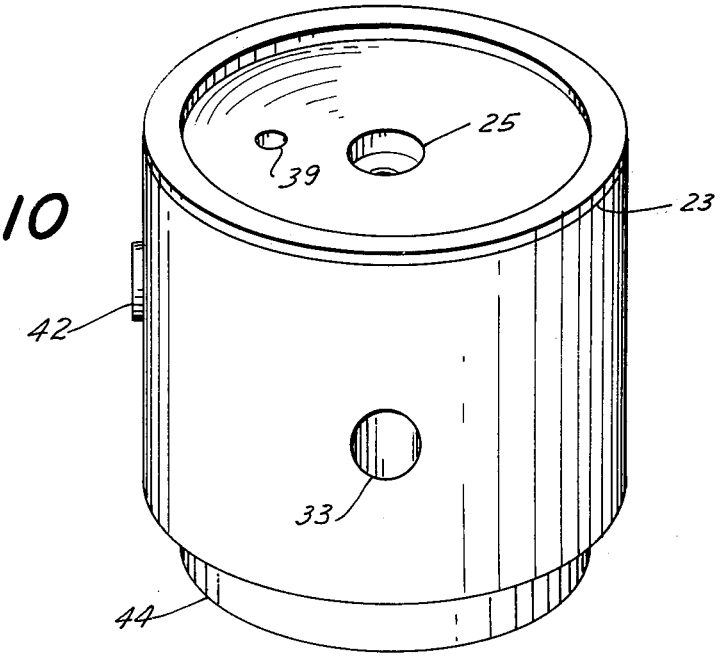
FIG. 10 is a perspective view of another embodiment of the vacuum chuck of the present invention.

It is not necessary to have the bore 25 in the center. FIG. 8 shows a vacuum chuck where the bore is off-center.

If desired, another horizontal passageway 43 may be provided to join with the L-shaped passageway. This can serve to hold a vacuum gauge to measure the vacuum.

The vacuum chuck as shown in FIG. 1 may also be provided with a base 44 having a smaller diameter if this should be desirable.

The block is constructed of metal or hard plastic, but a metal such as stainless steel or aluminum is preferred.

The gasket is constructed of a rubber or any suitable rubber-like or plastic material which will retain a vacuum. The O-ring may be constructed of similar material.

In operating the vacuum chuck, the lens is placed on top of the chuck and aligned. The screw cap 42 is tightened and air is blown in through the venturi. While the air can be blown in under any pressure, we prefer to use a pressure of about 30–80 psi which is readily obtainable from readily available air compressors. Once the desired vacuum is obtained the air pressure is shut off, and the lens is ready for grinding.

The chuck is assembled by inserting the spring into the vertical bore and then inserting the metal sphere. The O-ring is then fitted into the annular groove, and the chuck is ready for use.

Using the vacuum chuck of the present invention, vacua of the order of over 28 lbs., about 60 mm, are obtained. This is sufficient to hold the lens in place during the grinding. The vacuum so obtained has held for over 72 hours.

When the grinding operation is completed, the vacuum can be released by opening the cap screw permitting air to enter the system.

Preferably, the diameter of the orifice in the venturi is as small as possible without interfering with the flow of air. With larger vacuum chucks for larger lens, the diameter of the orifice can be increased without reducing the vacuum obtained.

We claim:

1. A vacuum chuck for use in lens grinding comprising a cylindrical block with a concave upper surface having on its outer edge an annular gasket whose outer diameter is equal to the diameter of the block; said block being provided with a vertical circular bore extending downward from the top of the block to join a through horizontal passageway in the block, the vertical bore being constricted before joining the through horizontal passageway; said vertical bore having resting therein a helical spring and a metallic sphere on top of the spring, the diameter of the sphere being less than the diameter of the bore, and an annular groove below the top opening of the bore, said groove holding an O-ring whose inner diameter is less than the diameter of the sphere; the through horizontal passageway having two opposed openings, one side of said passageway being constricted towards the center of the block to form a venturi which meets the bottom opening of the vertical bore, and the other side of the passageway being widened beyond the venturi; and a separate L-shaped passageway comprising a horizontal portion going inward from the side of the block to join a vertical portion going downward from the top of the block, the horizontal portion being threaded and holding a screw cap.

2. A vacuum chuck according to claim 1 wherein the top opening of the vertical bore is substantially in the center of the top of the block.

3. A vacuum chuck according to claim 2 wherein the horizontal portion of the L-shaped passageway is in a direction substantially at right angle to the direction of the through horizontal passageway.

4. A vacuum chuck according to claim 3, wherein the horizontal portion of the L-shaped passageway is joined to a horizontal passageway extending inwardly from the size of the block.

5. A vacuum chuck according to claim 4, wherein the block is provided with a base of smaller diameter.

6. A vacuum chuck according to claim 5, wherein the block is fabricated from aluminum or stainless steel.

* * * * *